United States Patent [19]

Miyashita et al.

[11] 4,165,169

[45] Aug. 21, 1979

[54] PHOTOSENSITIVE DRUM FOR ELECTROGRAPHIC APPARATUS

[75] Inventors: Kiyoshi Miyashita; Katsuhiko Kimura, both of Hachioji, Japan

[73] Assignee: Olympus Optical Company Limited, Tokyo, Japan

[21] Appl. No.: 834,849

[22] Filed: Sep. 19, 1977

[30] Foreign Application Priority Data

Sep. 24, 1976 [JP] Japan ..... 51-13760

[51] Int. Cl.[2] ..... G03G 15/00

[52] U.S. Cl. ..... 355/3 DR; 355/3 SC

[58] Field of Search ..... 355/3 R, 3 DR, 3 SC

[56] References Cited

U.S. PATENT DOCUMENTS

| | | | |
|---|---|---|---|
| 3,490,841 | 1/1970 | Cely et al. | 355/3 DR |
| 3,985,432 | 10/1976 | Hou et al. | 355/3 SC |
| 4,076,402 | 2/1978 | Kanno et al. | 355/3 DR |
| 4,113,372 | 9/1978 | Kimura et al. | 355/3 SC |
| 4,120,576 | 10/1978 | Babish | 355/3 DR |

FOREIGN PATENT DOCUMENTS 2021409 11/1971 Fed. Rep. of Germany ..... 355/3 DR

*Primary Examiner*—A. D. Pellinen

*Attorney, Agent, or Firm*—Haseltine, Lake & Waters

[57] ABSTRACT

An improved electrographic apparatus employing a photosensitive drum of a foil-shaped photosensitive body wound around a disc shaped frame. The drum is inserted into and removed from the electrographic apparatus body and there are first and a second bar-shaped members secured to opposed peripheral edges of the foil-shaped photosensitive drum and engaged with said disc-shaped frames, respectively. Current supply rings are concentrically arranged on and secured to the outer surface of one of the disc-shaped frames, the foil-shaped photosensitive body is provided with an electrically conductive substrate connected through a first of the bar-shaped members and a tension spring and one of the current supply rings to a bias voltage source. The electrically conductive layer of the foil-shaped photoconductive body is connected through a lead wire, an electrically conductive member embedded in the disc and the other current supply ring to the bias voltage source.

3 Claims, 5 Drawing Figures

PHOTOSENSITIVE DRUM FOR ELECTROGRAPHIC APPARATUS

BACKGROUND OF THE INVENTION

This invention relates to an electrographic apparatus comprising a photosensitive drum composed of a foil-shaped photosensitive body wound around a pair of disc-shaped frames and a corona discharge device arranged in the photosensitive drum and emitting a flow of corona ions toward the photosensitive drum.

An electrographic apparatus has been proposed which makes use of a foil-shaped photosensitive body of four layers construction comprising an electrically conductive substrate having a number of openings, a photosensitive layer coated on one side of the substrate, an insulating layer coated on the other side of the substrate and an electrically conductive layer coated on the insulating layer, and in which the photosensitive body is uniformly charged, then is exposed to a light image of a manuscript to be copied so as to produce, on the foil-shaped photosensitive body, a first electrostatic latent image corresponding to the manuscript image and subsequently a flow of corona ions is modulated on the basis of the first electrostatic latent image so as to transfer, onto an electrostatic record sheet, a second electrostatic latent image corresponding to the first electrostatic latent image. The second electrostatic latent image produced on the electrostatic record sheet is developed and fixed to obtain a visible image. This apparatus is capable of controlling each of successive steps in any suitable manner by adjusting a bias voltage applied between the electrically conductive substrate and the electrically conductive layer of the foil-shaped photosensitive body, and hence is significantly useful in practice.

In such electrographic apparatus, the foil-shaped photosensitive body is often composed of a drum-shaped body for the purpose of making the copying speed high and making the apparatus compact in construction.

In an electrographic apparatus which makes use of a photosensitive drum composed of a foil-shaped phototsensitive body, it is desirous to construct the apparatus such that the photosensitive drum and the corona discharge device can be removed from the apparatus for the purpose of replacing or cleaning the foil-shaped photosensitive body and the corona discharge device. Such method of removing the photosensitive drum and the corona discharge device from the apparatus is mainly divided into a method of pulling out the photosensitive drum and the corona discharge device in an axial direction of the drum and another method of removing the photosensitive drum and the corona discharge device in a direction for feeding a record sheet to be copied. In general, the former method of pulling out the photosensitive drum and the corona discharge device in the axial direction of the drum is simple in construction.

SUMMARY OF THE INVENTION

An object of the invention, therefore, is to provide an electrographic apparatus which can pull out a photosensitive drum and a corona discharge device in an axial direction of a drum in a simple manner.

A feature of the invention is the provision in an electrographic apparatus comprising a photosensitive drum composed of a foil-shaped photosensitive body wound around a disc-shaped frame and a corona discharge device arranged in the photosensitive drum and emitting a flow of corona ions toward the photosensitive drum, of the improvement comprising means for detachably mounting the photosensitive drum on an electrographic apparatus body and means for detachably mounting the corona discharge device on the photosensitive drum, the corona discharge device with or without the photosensitive drum being inserted into and removed from the electrographic apparatus body.

DESCRIPTION OF THE DRAWINGS

The invention will now be described in greater detail with reference to the accompanying drawings, wherein.

DESCRIPTION OF THE PREFERRED EMBODIMENTS

Figure 1:
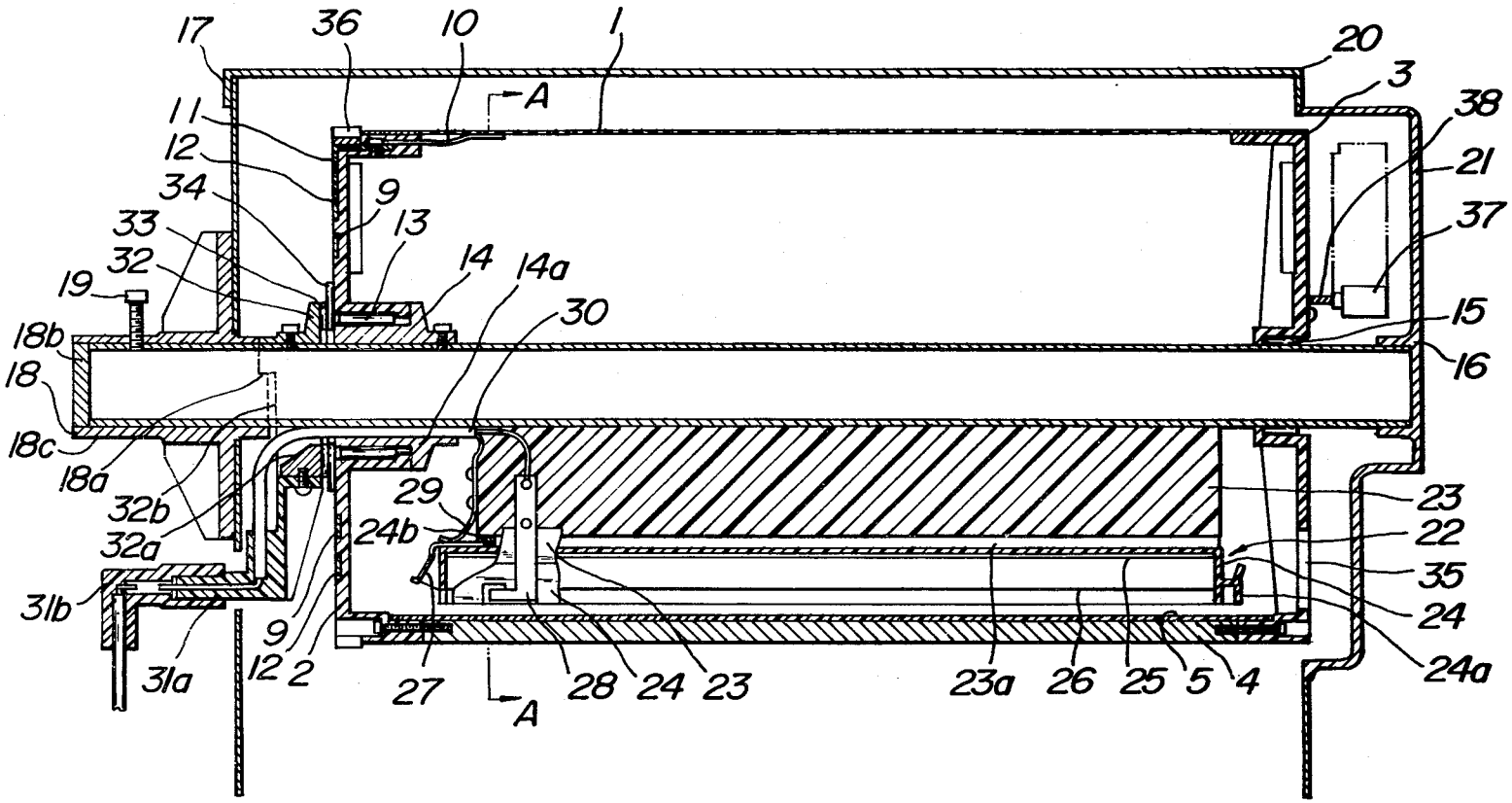
FIG. 1 is a longitudinal sectional view of one embodiment of a photosensitive drum for an electrographic apparatus according to the invention.
Figure 2:
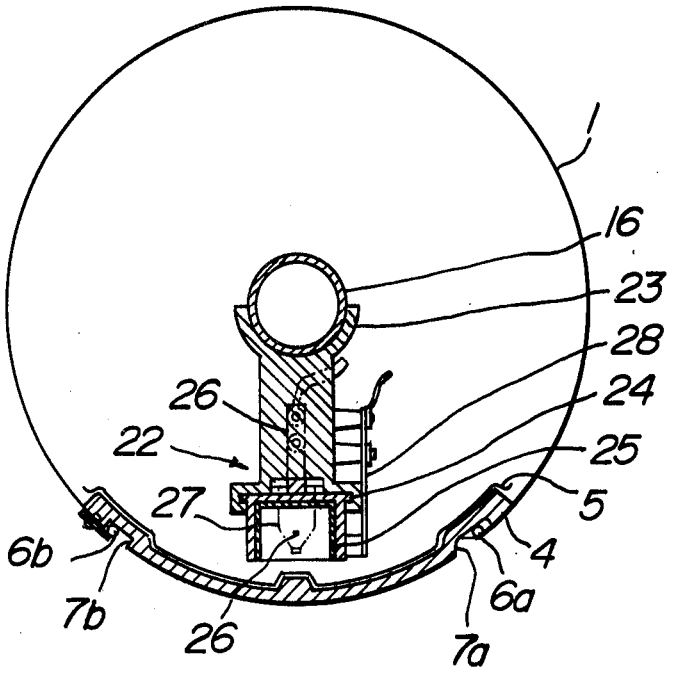
FIG. 2 is a section on line A—A of FIG. 2.
Figure 3:
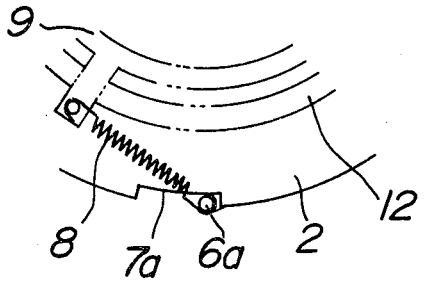
FIG. 3 is a partial side elevational view of a foil-shaped photosensitive body secured to a disc-shaped frame.

In FIG. 1 is shown one embodiment of a photosensitive drum for an electrographic apparatus according to the invention. In the present embodiment, a foil-shaped photosensitive body 1 is wound around a drum-shaped frame composed of a pair of insulating discs 2, 3 separated from each other and a segment-shaped connection member 4 for connecting opposed peripheral inner surfaces of the discs 2, 3 with each other. The connection member 4 may be formed of an insulating material. Alternatively, the connection member 4 may be formed of metal for the purpose of reinforcing the drum-shaped frame. In this case, the metal connection member 4 is provided at its inside with an insulating plate or an insulating coating 5 as shown in FIGS. 1 and 2. In the present embodiment, the foil-shaped photosensitive body 1 is of four layers construction comprising an electrically conductive substrate having a number of opening, a photosensitive layer coated on one side of the substrate, an insulating layer coated on the other side of the substrate and an electrically conductive layer coated on the insulating layer. The foil-shaped photosensitive body 1 is provided at its opposed end edges with clamping bars *6a*, *6b*, respectively, electrically connected to the electrically conductive substrate of the photosensitive body 1. The foil-shaped photosensitive body 1 is wound around the drum-shaped frames 2, 3 with the photosensitive layer faced outwardly and its clamping bars *6a*, *6b* are made engaged with grooves *7a*, *7b* formed in the drum-shaped frames 2, 3, respectively, as shown in FIG. 2. One of the clamping bars *6a* is connected through a tension spring 8 to a current supply ring 9 secured to the outer surface of the disc 2 as shown in FIG. 3. An opposite end of the clamping bar *6a* is connected through an electrically conductive or insulating tension spring (not shown) to an inner or outer surface of the disc 3. As a result, the foil-shaped photosensitive body 1 is wound around the drum-shaped frames 2, 3 under tension by means of the tension springs.

The electrically conductive layer of the foil-shaped photosensitive body 1 is connected through a lead wire 10 to an electrically conductive member 11 embedded in the disc 2 and electrically connected to a current supply ring 12 arranged concentrically with the current supply ring 9 secured to the outer surface of the disc 2.

The photosensitive drum 1 is rotatably mounted on a hollow fixed shaft 16 through a bearing 13 and sleeve 14 at the side of the disc 2 and through a bearing 15 at the side of the disc 3. One end of the fixed shaft 16 is secured to an end supporting pipe 18 by means of a screw 19, the pipe 18 being secured to one of side walls 17 of the apparatus. The other end of the fixed shaft 16 is supported by a side wall cover 21 detachably mounted on the other side wall 20.

The current supply rings 9 and 12 are connected through slidable brushes secured to a fixed member (not shown) to a bias electric source so as to supply a desired bias voltage between the electrically conductive substrate and the electrically conductive layer of the foil-shaped photosensitive body 1.

In the photosensitive drum is arranged a corona discharge device 22 which functions to uniformly charge the foil-shaped photosensitive body 1 and functions to emit a flow of corona ions in the case of producing, on a record sheet to be copied, a second electrostatic latent image on the basis of a first electrostatic latent image produced on the foil-shaped photosensitive body 1.

As shown in FIGS. 1 and 2, the corona discharge device 22 is composed of an insulating outer cover 24 slidably supported by a supporting frame 23 secured to the fixed shaft 16, a shield plate 25 lining the inner wall of the outer cover 24 and a corona discharge wire 26 extending across the shield plate 25. The corona discharge wire 26 is secured at its one end to the outer cover 24 and secured at the other end thereof to an electrically conductive plate spring 27 secured to the outer cover 24. The supporting frame 23 is provided at its one side with a current supplying plate spring 28 which makes contact with that part of the shield plate 25 which is exposed through one side surface of the outer cover 24 when the corona discharge device 22 is mounted in the photosensitive drum. In this case, the corona discharge wire 26 is connected through the plate spring 27 to a current supply plate spring 29 secured to the supporting frame 23 and urged against the plate spring 27. These current supplying plate springs 28 and 29 are connected through a lead wire 30 and current supplying connectors 31*a*, 31*b* to a corona supplying electric source (not shown). Between the sleeve 14 and the end supporting pipe 18 is inserted a thrust flange 32 which is secured to the fixed shaft 16 and functions to determine the position of the fixed shaft 16 with the aid of the end supporting pipe 18. The sleeve 14 and the thrust flange 32 are provided at their center thereof with holes 14*a* and 32*a*, respectively, through which is extended the lead wire 30. Between the thrust flange 32 and the disc 2 of the photosensitive drum are sandwiched a thrust spring 33 and a thrust bearing 34. The end supporting pipe 18 and the thrust flange 32 are provided at their opposed ends with steps 18*a* and 32*b*, respectively, which become engaged with each other so as to determined the position of the fixed shaft 16.

In order to pulling out the corona discharge device 22 in the axial direction of the photosensitive drum when the drum arrives at its normal stop position, the disc 3 is provided near the periphery thereof with an opening 35 which permits the corona discharge device 22 to be passed therethrough. In addition, the outer cover 24 of the corona discharge device 22 is provided at its rear end with a grip 24*a* by which an operator can easily pull out the corona discharge device 22 through the opening 35. In addition, the outer cover 24 is provided near at its front end with a projection 24*b* adapted to be engaged with a front end of a guide groove 23*a* formed in the lower end of the supporting frame 23 when the corona discharge device 22 is mounted on the supporting frame 23, thereby determining the position of the corona discharge device 22.

The photosensitive drum is provided at its outer periphery with a gear 36 geared with a gear (not shown) connected to a driving motor.

To the side wall cover 21 are secured a group of microswitches 37 and the disc 3 is provided at its outer side surface with sequence plates 38 (only one is shown) concentrically arranged and adapted to be engaged in sequence with the microswitches 37 when the photosensitive drum is rotated so as to effect a reciprocating motion of a manuscript scanning device, a step of feeding a record sheet to be copied, first and second charging steps of the corona discharge device 22, etc. in succession.

In the construction as above described, when the photosensitive drum is stopped with the opening 35 formed in the disc 3 opposed to the corona discharge device 22, the corona discharge device 22 can easily be pulled out through the opening 35, so that repair, cleaning, etc. of the corona discharge device 22 can be effected outside the electrographic apparatus.

Figure 4:
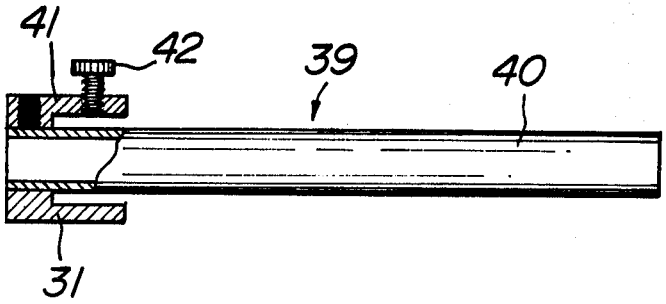
FIG. 4 is a front elevational view of a guide member used in the case of inserting a photosensitive drum into an electrographic apparatus body and removing the former from the latter, a part being shown in section.
Figure 5:
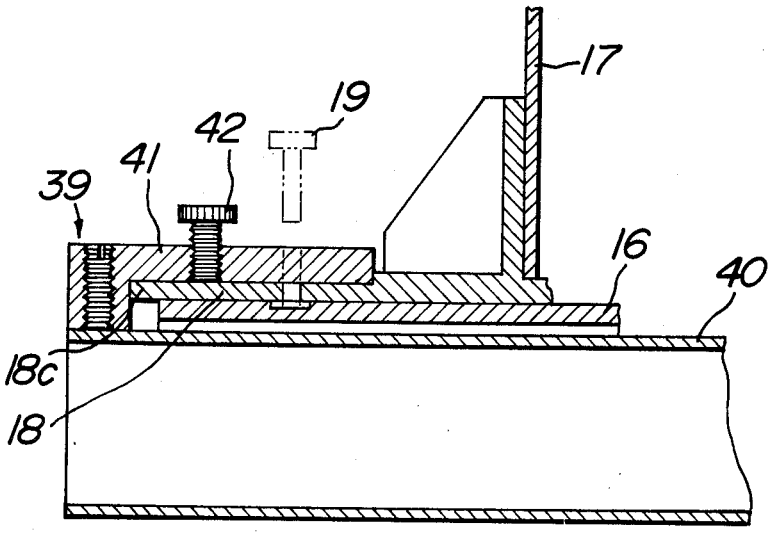
FIG. 5 is a partial enlarged sectional view of the guide member shown in FIG. 4 and mounted on the photosensitive drum shown in FIG. 1.

In FIG. 4 is shown a guide member 39 composed of a hollow shaft 40 adapted to be freely inserted into the fixed shaft 16 and a flange 41 secured to one end of the shaft 40. The guide member 39 functions to guide the fixed shaft 16 and the corona discharge device 22 secured through the supporting frame 23 to the fixed shaft 16 when the fixed shaft 16 and the corona discharge device 22 are removed out of the electrographic apparatus.

In the case of effecting exchanging, cleaning, etc. of the foil-shaped photosensitive body 1 of the photosensitive drum, when the photosensitive drum is stopped with the opening 35 formed in the disc 3 opposed to the corona discharge device 22, an end cover 18*b* of the end supporting pipe 18 is removed and a screw 19 for securing the fixed shaft 16 to the end supporting pipe 18 is also removed. Then, the shaft 40 of the guide member 39 is inserted into the fixed shaft 16 with the flange 41 engaged with a reduced diameter neck portion 18*c* of the end supporting pipe 18. Then, the flange 41 is secured to the end supporting pipe 18 by means of a screw 42. As a result, the fixed shaft 16 can be pulled out of the end supporting pipe 18 and hence it is possible to pull out the fixed shaft 16 and the corona discharge device 22 secured through the supporting frame 23 thereto in the axial direction thereof along the shaft 40 of the guide member 39. In this case, the current supplying connector 31*a* is disconnected from the current supplying connector 31*b* and the side wall cover 21 is also removed from the side wall 20.

The photosensitive drum may be mounted on the electrographic apparatus in a manner opposite to that described above.

As described above, when both the corona discharge device 22 and the photosensitive drum are removed from the apparatus body, the side wall cover 21 is removed. In this case, the microswitches 37 secured to the side wall cover 21 are disconnected from the sequence plates 38, so that the sequential operations for driving the electrographic apparatus become inoperative.

As stated hereinbefore, the electrographic apparatus according to the invention is capable of inserting the photosensitive drum together with the corona discharge device into the apparatus body and removing them from the latter and is also capable of inserting and removing the corona discharge device into and from the apparatus body, so that exchange and cleaning of the foil-shaped photosensitive body and repair, etc. of the corona discharge device can easily be effected outside the apparatus.

What is claimed is:

1. An improved electrographic apparatus comprising a photosensitive drum formed of a foil-shaped photosensitive body wound around a disc-shaped frame, a corona discharge device arranged in the photosensitive drum and emitting a flow of corona ions toward the photosensitive drum, means for detachably mounting the photosensitive drum on an electrographic apparatus body, the photosensitive drum being inserted into and removed from the electrographic apparatus body, said improvement comprises: first and a second bar-shaped members secured to opposed peripheral edges of said foil-shaped photosensitive drum and engaged with said disc-shaped frames, respectively, and current supply rings concentrically arranged on and secured to the outer surface of one of said disc-shaped frames, said foil-shaped photosensitive body having an electrically conductive substrate being connected through a first of said bar-shaped members, a tension spring and one of said current supply rings to a bias voltage source and said electrically conductive layer of said foil-shaped photoconductive body being connected through a lead wire, an electrically conductive member embedded in the disc member and the other current supply ring to said bias voltage source.

2. The appratus according to claim 1, wherein: a shaft of said photosensitive drum is hollow and provided at its one end with supporting pipe detachably secured to said shaft, a guide member formed of a hollow shaft freely inserted into said shaft and a flange secured to one end of said hollow shaft whereby said photosensitive drum inclusive of said shaft is insertable into and removeable from said electrographic apparatus.

3. The apparatus according to claim 1 and comprising further sequence plates concentrically arranged on one side surface of said photosensitive drum, a detachable side wall cover for supporting one end of a fixed shaft of said photosensitive drum and a group of microswitches arranged on said detachable side wall cover, said side wall cover being removed from said apparatus body and rendering sequential operations for driving said electrographic apparatus inoperative.

* * * * *